US006012565A

United States Patent [19]

Mazur

[11] Patent Number: 6,012,565

[45] Date of Patent: Jan. 11, 2000

[54] INTELLIGENT CURRENCY HANDLING SYSTEM

[75] Inventor: Richard A. Mazur, Naperville, Ill.

[73] Assignee: Cummins-Allison Corp., Mt. Prospect, Ill.

[21] Appl. No.: 08/852,400

[22] Filed: May 7, 1997

[51] Int. Cl.[7] ..... G06M 7/06; G07D 7/00

[52] U.S. Cl. ..... 194/207; 377/8

[58] Field of Search ..... 194/206, 207; 377/8; 209/534; 382/135

[56] References Cited

U.S. PATENT DOCUMENTS

| | | | |
|---|---|---|---|
| 4,707,843 | 11/1987 | McDonald et al. | 377/8 |
| 4,953,086 | 8/1990 | Fukatsu | 235/379 X |
| 5,295,196 | 3/1994 | Raterman et al. | 382/135 |
| 5,580,311 | 12/1996 | Haste, III | 463/29 |
| 5,640,463 | 6/1997 | Csulits | 382/135 |

OTHER PUBLICATIONS

Verified Translation of PCT 96/72651.

*Operation Manual For Maintenance and Learning Modes for tellac–5, 5DD, SD, DDA, A & SSD*, Musashi Co., Ltd., various pages.

Model 4050/4051 Form #022–7014–00, pp. 14–15.

"The Learning Mode of Tellac–3 . . . ", pp. 1–4.

*Primary Examiner*—F. J. Bartuska
*Attorney, Agent, or Firm*—Arnold, White & Durkee

[57] ABSTRACT

A currency handling system adapted to accommodate currencies of any denomination or type without having been pre-programmed with data representative of the denominations or types. The currency handling system is capable of generating such data internally, by scanning a set of master currency bills to obtain master information representative of the master bills which may be used to authenticate subsequent test bills according to selected or default sensitivity levels. The master information may comprise numerical and/or non-numerical data. The determination of authenticity of the test bills is based on a comparison of either pre-stored or self-generated master information with scanned data values associated with the test bills. In one embodiment, a note counter is provided which authenticates and counts a stack of same denomination bills after independently determining the denomination of the bills and selecting appropriate threshold levels corresponding to the denomination of the bills.

Master information derived by one machine may be quickly and efficiently loaded into a plurality of additional machines through a flash card loading system. The master information is stored in a resident flash memory of a first machine, then copied onto the memory of a flash card electrically coupled to the first machine. The flash card may then be removed from the first machine and electrically coupled to a selected number of secondary machines, causing the master information to be transferred to the resident flash memory of the secondary machines. The master information is then used to authenticate test bills in the secondary machines in substantially the same manner described above. In one embodiment, the master information and characteristic data values are normalized before the authentication step is performed to account for variations in individual machines.

16 Claims, 8 Drawing Sheets

FIG. 5 TIMING DIAGRAM

INTELLIGENT CURRENCY HANDLING SYSTEM

FIELD OF THE INVENTION

The present invention relates generally to the field of currency handling systems and, more particularly, to a currency handling system having the capability to accommodate previously unforeseen currency bills, analyze selected attributes of the bills and independently generate master information associated with the selected attributes which may be used in evaluating subsequent currency bills.

BACKGROUND OF THE INVENTION

A variety of techniques and apparatus have been used to satisfy the requirements of automated currency handling machines. At the upper end of sophistication in this area of technology are machines which are capable of rapidly identifying, discriminating and counting multiple currency denominations. This type of machine, hereinafter designated as a "denomination discriminator," typically employs either magnetic sensing or optical sensing for identifying the denominations of bills in a stack and discriminating between different currency denominations. At a lower level of sophistication in this area are machines which are designed to rapidly count the number of currency bills in a stack, but which are not designed to identify or discriminate among multiple currency denominations. This type of machine, hereinafter designated as a "counter," may include magnetic or optical sensors sufficient to enable it to discriminate between acceptable and non-acceptable bills in a stack of bills having a known denomination, but typically do not permit the machine to identify the denomination of bills or discriminate among multiple denominations of currency. Consequently, counters known in the art do not typically "know" what denomination they are counting until they are informed of the particular denomination by an external signal or operator.

Whether employed in a denomination discriminator or counter, magnetic sensing is based on detecting the presence or absence of magnetic ink in portions of the printed indicia on the currency by using magnetic sensors, usually ferrite core-based sensors, and using the detected magnetic signals, after undergoing analog or digital processing, as the basis for discrimination. The more commonly used optical sensing technique, on the other hand, is based on detecting and analyzing variations in light reflectance or transmissivity characteristics occurring when a currency bill is illuminated and scanned by a strip of focused light. The subsequent currency discrimination is based on the comparison of sensed optical or magnetic characteristics with prestored parameters relating to different currency denominations, while accounting for adequate tolerances reflecting differences among bills of a given denomination. Similarly, the acceptance or rejection of a bill is based on the comparison of sensed optical or magnetic characteristics with prestored parameters defining an acceptable bill, while accounting for adequate tolerances reflecting differences among bills of a given denomination. An example of a currency handling machine using an optical scanning technique is described in U.S. Pat. No. 5,295,196, issued Mar. 15, 1994 to Raterman et al. and assigned to Cummins-Allison Corporation, incorporated herein by reference.

Currency handling machines (e.g. denomination discriminators or counters) known in the art typically include a system memory for storing prestored parameters associated with the magnetic or optical characteristics of the various currency denominations to be evaluated or counted. The types or denominations of currency which a machine is able to accommodate is dependent on the prestored parameters with which it has been programmed. For example, a machine designed for U.S. markets must be programmed with prestored parameters associated with magnetic or optical characteristics of U.S. currency, while a machine designed for a foreign market must be programmed with prestored parameters associated with the appropriate foreign currency. A machine designed for one market will be unable to accommodate currency from the another market unless it has been encoded with the appropriate prestored parameters for that other market. Additionally, once programmed with the appropriate prestored parameters, the system memory must be updated or supplemented periodically in order to reflect the most recent optical or magnetic characteristics of the various currency denominations to be evaluated, which may occur, for example, upon the issuance of a new series of bills.

Heretofore, the encoding or updating of prestored parameters into the system memory of discrimination machines or counters have been accomplished externally from the machine, typically at a factory or service center. For example, in discrimination machines employing memory chips such as erasable programmable read only memorys (EPROMs), the chips are typically programmed or updated at the factory or service center and either installed in the machine at the factory or, in the case of updates, shipped to the customer for re-installation in the machine. An alternative method of encoding or updating prestored parameters may be utilized in discrimination machines employing "flash card" technology, such as described in U.S. patent application Ser. No. 08/715,029, now issued as U.S. Pat. No. 5,909,502, assigned to the assignee of the present invention and incorporated herein by reference. In such a "flash card" loading system, a flash card is programmed with the desired code and the machine may be encoded or updated by inserting the flash card into the machine, causing the system memory to become replaced with the flash card memory. Nevertheless, in either of the above prior systems, the source of the code is external to the machine, typically at the factory or service center level, and the discrimination capability of a particular machine is limited to only those bills associated with the pre-stored parameters with which it has been programmed.

Accordingly, in view of the above-described problems, there is a need for a currency handling system that is able to accommodate currencies of several denominations and types without having been externally programmed or updated with pre-stored parameters associated with those denominations and types. Similarly, there is a need for a note counter which is able to determine the denomination of currency it is counting without having been informed of the denomination by an external signal or operator. The present invention is directed to satisfying or at least partially satisfying these needs.

SUMMARY OF THE INVENTION

In accordance with one aspect of the present invention, there is provided a currency handling system in which a set of master currency bills are scanned by a primary machine to obtain master information associated with one or more attributes of the master currency bills. The master information is stored in the memory of the primary machine and includes data which may be used to evaluate subsequent currency bills. In one embodiment, the master information comprises thresholds of acceptability which may be used to evaluate subsequent currency bills. The master information may be copied from the memory of the primary machine to the memory of a plurality of secondary machines. In either the primary or secondary machine, a stack of test bills is scanned to obtain test data corresponding to the value of a selected attribute in the test bills. The authenticity of the test bills is determined by comparing the test data associated with a selected attribute of the test bills to the master information corresponding to the selected attribute of the test bills.

In accordance with another aspect of the present invention, there is provided a software loading system which may be used to copy master information and other data from a primary currency handling machine to a plurality of secondary currency handling machines. A flash card having a flash memory therein is removably electrically coupled to the resident flash memory of the primary currency handling machine. Master information is copied from the resident flash memory of the primary currency handling machine to the flash card memory in response to the flash card being electrically coupled to the primary machine. The flash card retains the master information after being removed from the primary machine. The flash card may then be removably electrically coupled to a plurality of secondary machines, causing the master information to be copied from the flash card memory to the resident flash memory in the secondary machines.

In accordance with yet another aspect of the present invention, there is provided a system for normalizing master information obtained from the primary currency handling machine and normalizing test data obtained from the secondary machines to account for measurement biases between individual machines. A substantially similar reference object in each machine is scanned by each respective machine to obtain a reference data value associated with each machine. Master information and/or test data obtained from each respective machine are normalized by dividing them by the reference data value associated with each respective machine. Authentication of test bills is performed by comparing normalized master information to normalized test data.

In accordance with still yet another aspect of the present invention, there is provided a note counter for counting a stack of currency bills having the same denomination. The note counter scans the currency bills to determine a scanned value associated with a selected attribute (e.g., size) of the currency bills. The note counter then independently determines the denomination of the currency bills based on the scanned value. An authentication sensitivity level is selected to correspond to the denomination of the currency bills and the currency bills are authenticated by comparing the scanned value to one or more items of master information associated with the authentication sensitivity level. The number of authentic currency bills is counted and the cumulative value may be displayed.

BRIEF DESCRIPTION OF THE DRAWINGS

The foregoing and other advantages of the invention will become apparent upon reading the following detailed description and upon reference to the drawings in which.

Figure 1:
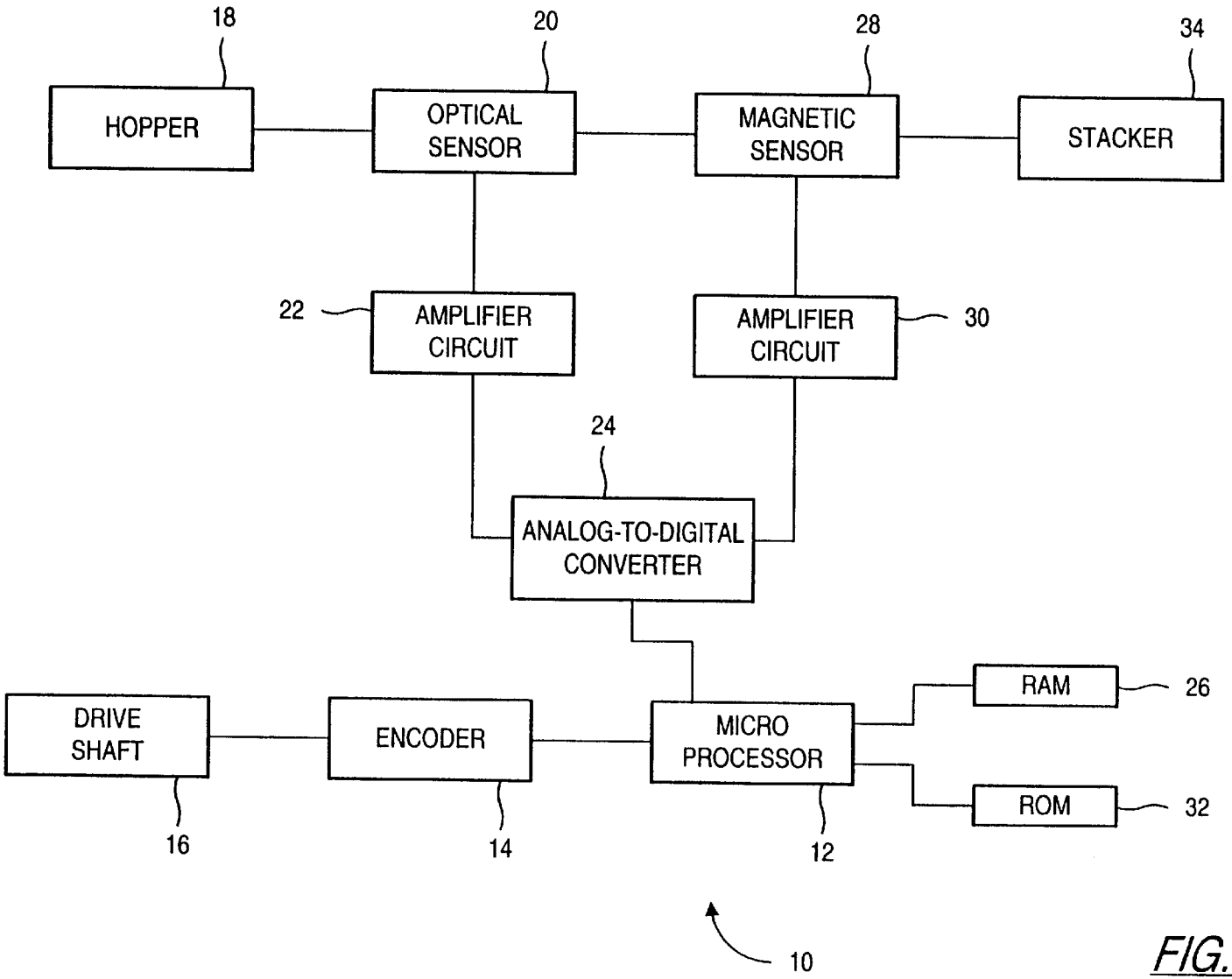
FIG. 1 is a block diagram of a currency handling system embodying principles of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

Description of Specific Embodiments

Referring to the drawings, FIG. 1 shows a block diagram of handling system 10 embodying principles of the present invention. A microprocessor 12 controls the overall operation of the currency handling system 10. It should be noted that the detailed construction of a mechanism to convey bills through the currency handling system 10 is not related to the practice of the present invention. Many configurations are well-known in the prior art. An exemplary configuration includes an arrangement of pulleys and rubber belts driven by a single motor, as shown in U.S. Pat. No. 5,295,196, assigned to the assignee of the present invention and incorporated herein by reference. An encoder 14 may be used to provide input to the microprocessor 12 based on the position of a drive shaft 16, which operates the bill-conveying mechanism. The input from the encoder 14 allows the microprocessor to calculate the position of a bill as it travels and to determine the timing of the operations of the currency handling system 10.

A stack of currency bills (not shown) may be deposited in a hopper 18 which holds the currency securely and allows the bills in the stack to be conveyed one at a time through the currency handling system 10. After the bills are conveyed to the interior of the currency handling system 10, a portion of the bill may be optically or magnetically scanned by a respective optical sensor 20 and/or magnetic sensor 28 of types commonly known in the art. The optical sensor 20 generates signals that correspond to the amount of light reflected by a small portion of the bill, while the magnetic sensor 28 is designed to detect the amount or pattern of magnetic ink on the bill. Signals from the optical or magnetic sensors 20, 28 are sent to respective amplifier circuits 22, 30 which, in turn, send output signals to an analog-to-digital converter 24. The output of the ADC is read by the microprocessor 12. The microprocessor 12 stores each element of data from the optical and/or magnetic sensors 20, 28 in a range of memory locations in a random access memory ("RAM") 26, forming a set of data values corresponding to the optical and/or magnetic scan of the representative currency bills.

The currency handling system 10 may be operated in a "standard" currency evaluation mode or "learn" mode. In the standard currency evaluation mode, the optical and/or magnetic data stored in the RAM 26 is compared by the microprocessor 12 to prestored master information stored in a read only memory ("ROM") 32. The prestored master information corresponds to optical and/or magnetic data generated from genuine "master" currency of a plurality of denominations and/or types. Typically, the prestored data represents an expected numerical value or range of numerical values associated with an optical or magnetic scan of genuine currency. The ROM image data may further represent various orientations and/or facing positions of genuine currency to account for the possibility of a bill in the stack being in a reversed orientation or reversed facing position compared to other bills in the stack. A determination of authenticity or denomination of a bill under test is based on a comparison of scanned optical and/or magnetic data associated with the test bill to the corresponding master data stored in ROM. For example, where the currency handling system 10 comprises a denomination discriminator, a stack of bills having undetermined denomination may be processed and the denomination of each bill in the stack determined by comparing data generated from the each bill to the prestored master information to determine which of the prestored parameters most closely matches the scanned bill. If the data from the bill under test sufficiently matches one of the prestored parameters, a determination of both denomination and authenticity may be made.

In contrast, a typical counter is designed to accommodate a stack of bills having the same, predetermined denomination. A typical counter thereby does not determine the denomination of the bills under test, but determines the authenticity of the bills after having been informed of the denomination and/or type of the bills by an external signal or operator. The denomination of the bills under test may be communicated to the counter through an operator interface panel such as a keyboard or touchscreen, or through a remote host system linked to the currency handling system, such as that described in pending U.S. patent application Ser. No. 08/722,808, assigned to the assignee of the present invention and incorporated herein by reference.

According to one embodiment of the present invention, the operator of a document handling device such as a note counter or a currency denomination discriminator is provided with the ability to set various sensitivity levels to perform the standard mode authentication tests. This may be achieved through an operator interface panel such as a keyboard or touchscreen, or through a remote host system as described above. For example, in one embodiment, the operator is provided with the ability to adjust a UV test (upper and lower), a fluorescent test, and a magnetic test in a range of sensitivities 1–10, with 10 being the most sensitive, or to turn each test off. The device permits setting the sensitivity as described above for the four authentication tests for both a low sensitivity (low denomination) mode and a high sensitivity (high denomination) mode. The above setting options are summarized in Table 1.

TABLE 1

| Mode | UV Test - Lower Sensitivity | UV Test - Upper Sensitivity | Fluorescent Test Sensitivity | Magnetic Test Sensitivity |
|---|---|---|---|---|
| High | Off, 1–10 | Off, 1–10 | Off, 1–10 | Off, 1–10 |
| Low | Off, 1–10 | Off, 1–10 | Off, 1–10 | Off, 1–10 |
| 1,2,5,10,20,50,100 | Off, 1–10 | Off, 1–10 | Off, 1–10 | Off, 1–10 |

According to an alternate embodiment, the above high/low modes are replaced with denomination modes, for example, one for each of several denominations of currency (e.g., $1, $2, $5, $10, $20, $50 and $100). For each denomination, the sensitivity of the four tests may be adjusted between 1–10 or off. According to one embodiment, the operator manually selects either the high or low mode or the appropriate denomination mode based on the values of the notes to be processed. This manual mode selection system may be employed in, for example, either a note counter or a currency denomination discriminator. According to another embodiment, the document handling system automatically selects either the high or low mode or the appropriate denomination mode based on the values of the notes being processed. This automatic mode selection system may be employed in systems capable of independently identifying the different values or kinds of documents, such as a denomination discriminator, or in systems which are externally informed of the denomination of documents to be processed, such as a note counter.

In the low mode or for low denomination modes (e.g., $1, $2) the three tests may be set to relatively low sensitivities (e.g., UV test set at 2, fluorescent test set at 5, and magnetic test set at 3). Conversely, in the high mode or for high denomination modes (e.g., $50, $100) the three tests may be set to relatively high sensitivities (e.g., UV test set at 5, fluorescent test set at 6, and magnetic test set at 7). In this way, authentication sensitivity may be increased when processing high value notes where the potential harm or risk in not detecting a counterfeit may be greater and may be decreased when processing low value notes where the potential harm or risk in not detecting a counterfeit is lesser and the annoyance of wrongly rejecting genuine notes is greater. Also the UV, fluorescent, and/or magnetic characteristics of genuine notes can vary due to number of factors such wear and tear or whether the note has been washed (e.g., detergents). As a result, the fluorescence detection of genuine U.S. currency, for example, may yield readings of about 0.05 or 0.06 volts.

With respect to U.S. currency, the UV and fluorescent thresholds associated with each of the ten sensitivity levels may be set, for example, as shown in Table 2.

TABLE 2

| Sensitivity Level | UV Test - Lower (Volts) | UV Test - Upper (Volts) | Fluorescence Test (Volts) |
|---|---|---|---|
| 1 | 0.200 | 2.200 | 0.800 |
| 2 | 0.325 | 2.100 | 0.600 |
| 3 | 0.450 | 2.000 | 0.400 |
| 4 | 0.550 | 1.900 | 0.200 |
| 5 | 0.600 | 1.800 | 0.150 |
| 6 | 0.650 | 1.700 | 0.100 |
| 7 | 0.700 | 1.600 | 0.090 |
| 8 | 0.750 | 1.500 | 0.080 |
| 9 | 0.800 | 1.450 | 0.070 |
| 10 | 0.850 | 1.400 | 0.060 |

Although the UV and flourescence threshold data associated with sensitivity levels 1–10 in Table 2 are derived with respect to U.S. currency, it will be appreciated that the sensitivity levels may be appropriately selected to authenticate foreign currency or other documents having known reflectance characteristics.

According to one embodiment of the present invention, the currency handling system 10 comprises a new type of counter that is capable of independently determining the denomination and/or type of the bills under test. The new type of counter combines features of the previously described currency denomination discriminator with features of prior art note counters and is thereby designated a "discriminating counter". Similar to prior art counters, the discriminating counter is designed to accommodate a stack of bills, each having the same denomination. In contrast to prior art note counters, however, the discriminating counter is not informed of the denomination of the bills but is rather designed to independently determine the denomination of the bills.

The discriminating counter makes an initial determination of the denomination of the bills under test by scanning one or more of the bills to determine a selected attribute of the bills such as, for example, their size or magnetic content, then compares the selected attribute to master information corresponding to the selected attribute in various denominations of currency. The initial determination of denomination of the bills is made by finding the denomination of currency whose master information most closely compares to the selected attribute of the bill(s) under test. Operating parameters may then be selected, either manually or automatically, corresponding to the initially determined denomination of the bills, and the authenticity of the remaining bills may be determined by the standard mode of operation described above. The selection of operating parameters may comprise, for example, the setting of sensitivity levels, displays, or generally any feature that may be varied in response to different denominations and/or types of currency.

For example, suppose that the discriminating counter is presented with a stack of 5£ British currency notes without having been informed of the denomination or type of the notes. According to one embodiment of the present invention, the discriminating counter makes an initial determination of the denomination of the stack of bills by scanning a first bill to derive a numerical test value corresponding to the size of the first bill, then compares the numerical test value to a set of master information stored in system memory.

According to one embodiment, the master information comprises numerical values corresponding to the respective sizes of various denominations and/or types of foreign currency, including 1£, 5£, 10£, 20£, 50£ and 100£ British notes. The denomination and/or type of the first bill (and expected denomination of the remainder of the stack) is chosen from among the several denominations and/or types corresponding to the threshold values by determining which one of the stored numerical values most closely matches the test value obtained from the first bill.

Thus, in the present example, the first bill (and expected denomination of the remainder of the stack) will most likely be determined to be a 5£ British note.

Based on this initial determination, any of several operating parameters may be set and the discriminating counter may determine the authenticity of the remaining bills in the stack. For example, according to one embodiment, the authentication sensitivity level and the operator interface panel/display of the discriminating counter is changed to correspond to 5£ British notes prior to determining the authenticity of the remaining bills. It will be appreciated that the determination of authenticity of the remainder of the test bills may be made by comparing any attribute of the bills to corresponding master information, notwithstanding the attribute used to make the initial determination of denomination. Thus, in the present example, although the attribute used to make the initial determination of denomination is size, the authenticity of the remaining bills may be made by comparing any attribute of the bills, such as size, magnetic content, UV reflectance levels, etc. to corresponding master information appropriate to the expected denomination of the bills. Heretofore, the master information used in evaluating currency in "standard" mode has been generated externally to the currency handling system 10. The master information is typically programmed at a factory or service center into a memory device such as an EPROM or flash card, then installed in the machine or shipped to the user for installation in the machine. Consequently, the ability of currency handling machines known in the art to discriminate or authenticate particular types and/or denominations of currency is dependent on the content of their associated memory device. The memory devices must therefore be appropriately encoded to correspond to the intended market in which they will be used. For example, a memory device to be used in a machine for discriminating U.S. currency must be encoded with master information corresponding to the magnetic or optical characteristics of U.S. currency, while a memory device used in a machine designated for foreign markets must be encoded with master information corresponding to the magnetic or optical characteristics of the appropriate foreign currency(s). A machine having a memory device encoded with master information appropriate to one market will generally be unable to accommodate currency from another market because it typically has not been encoded with the appropriate master information for that other market.

In the "learn" mode, the present invention is designed to overcome the problems associated with the prior art by permitting the currency handling system 10 to generate the necessary master information independently, without having been pre-programmed with such master information. In the learn mode, a stack of representative "master" currency bills is deposited in the hopper 18 and fed through the system 10 as described above. The master currency bills will preferably comprise a series of bills each having the same denomination and type, but may represent bills which are initially unrecognizable to the currency handling system 10. As the master currency bills are conveyed through the currency handling system 10, they are optically and/or magnetically scanned and master information corresponding to the optical and/or magnetic scan of the master bills is stored in a random access memory ("RAM") 26.

According to one embodiment of the present invention, the master information comprises numerical data associated with various denominations of currency bills. The numerical data may comprise, for example, thresholds of acceptability to be used in evaluating test bills, based on expected numerical values associated with the currency or a range of numerical values defining upper and lower limits of acceptability. The thresholds may be associated with various sensitivity levels, as described in relation to Table 1 and Table 2. Alternatively, the master information may comprise non-numerical information associated with the currency such as, for example, optical or magnetic patterns, symbols, codes or alphanumeric characters. In either case, the master information comprises internally generated parameters which may be used in evaluating test bills in the same manner described above in relation to the standard mode of operation.

Figure 2:
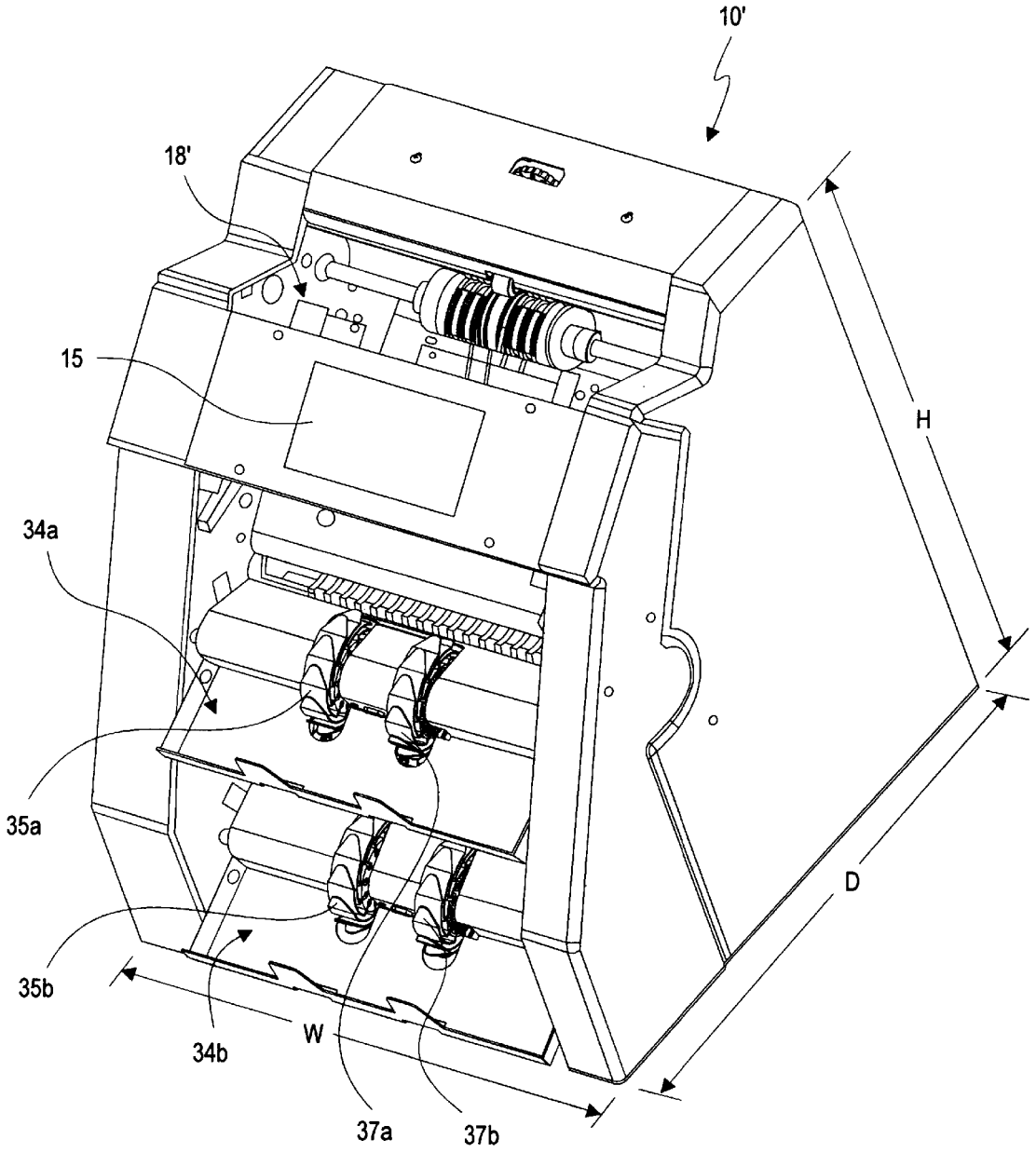
FIG. 2 is a perspective view of a two-pocket document currency handling system according to one embodiment of the present invention.

After evaluation of the bills by the currency handling system 10, each of the bills is transported to a stacker 34 which may include one or more "pockets" or output receptacles for receiving the bills. For example, FIG. 2 portrays one embodiment of the present invention in which the currency handling system, designated by reference numeral 10', includes a two-pocket stacker. The currency handling system 10' shown in FIG. 2 is described in detail in U.S. provisional patent application Ser. No. 60/034,954, filed Jan. 16, 1997, entitled "Method and Apparatus for Document Processing" and U.S. provisional patent application Ser. No. 60/038,340, filed Feb. 27, 1997, entitled Method and Apparatus for Document Processing, each of which is assigned to the assignee of the present invention and incorporated herein by reference.

According to one embodiment of the present invention, the currency handling system 10' is compact, having a height (H) of about 17½ inches, width (W) of about 13 ½ inches, and a depth (D) of about 15 inches, such that it may be rested upon a tabletop. Currency bills are fed, one by one, from a stack of currency bills placed in the input receptacle (e.g. "hopper") 18' into a transport mechanism (not visible in FIG. 2), which guides the currency bills across optical and/or magnetic sensors (not visible in FIG. 2) to one of two output receptacles 34*a* and 34*b*. In one embodiment, the currency handling system 10' is capable of transporting, scanning, and determining the denomination and/or authenticity of the bills at a rate in excess of 800 to 1000 bills per minute. In another embodiment, the currency handling system 10' has a touch panel display 15 which displays appropriate "functional" keys and/or operating parameters when appropriate. The touch panel display 15 simplifies the operation of the currency handling system 10'. Physical keys or buttons may also be employed. Stacking of the bills is accomplished by a pair of driven stacking wheels 35*a* and 37*a* for the first or upper output receptacle 34*a* and by a pair of stacking wheels 35*b* and 37*b* for the second or bottom output receptacle 34*b*. The stacker wheels 35*a, b* and 37*a, b* are supported for rotational movement about respective shafts (not shown) journalled on a rigid frame and driven by a motor. A diverter (not shown) directs the bills to either the first or second output receptacle 34*a,* 34*b*.

Figure 3:
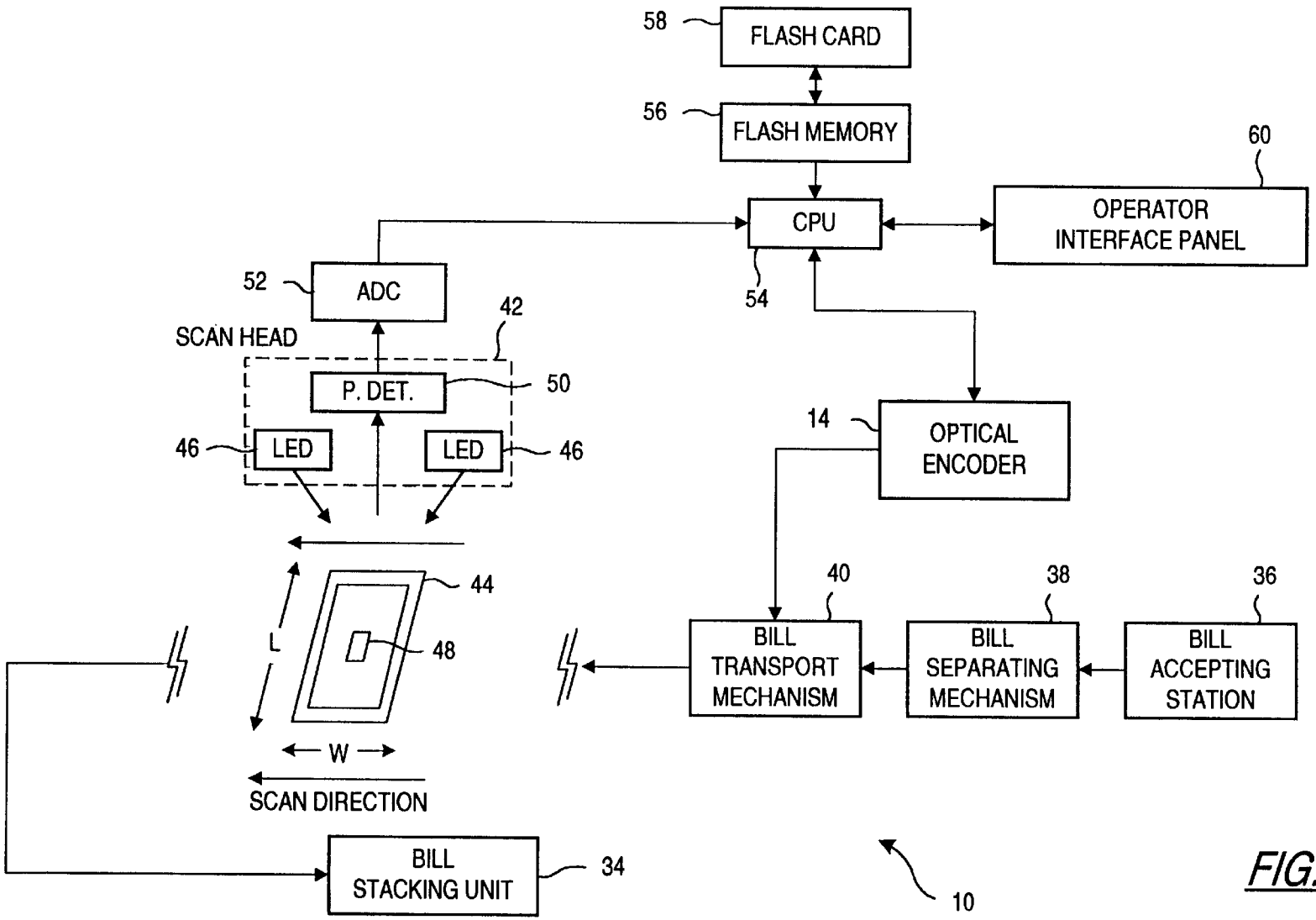
FIG. 3 is a functional block diagram illustrating one embodiment of the currency handling system according to the present invention.

Now turning to FIG. 3, there is depicted a functional block diagram of a currency handling system 10 embodying principles of the present invention. Currency bills to be evaluated (in "standard" mode) or from which master information will be generated (in "learn" mode) are positioned in a bill accepting station 36. Accepted bills are acted upon by a bill separating mechanism 38 which functions to pick out or separate one bill at a time for being sequentially relayed by a bill transport mechanism 40, according to a precisely predetermined transport path, across an optical scanhead 42. It will be appreciated that the currency handling system may also include a magnetic scanhead. The optical or magnetic scanheads are designed to scan for characteristic test data from a scanned bill 44 which is used to authenticate or identify the denomination of the bill. In the embodiment shown in FIG. 3, the optical scanhead 42 comprises at least one light source 46 directing a beam of coherent light downwardly onto the bill transport path so as to illuminate a substantially rectangular light strip 48 upon the currency bill 44 positioned on the transport path below the scanhead 42. Light reflected off the illuminated strip 48 is sensed by a photodetector 50 positioned directly above the strip. After passing across the optical scanhead 42, each of the bills is transported to a bill stacking unit 34 which may include a plurality of "pockets" or output receptacles for receiving the bills, as described in relation to FIG. 1.

The analog output of the photodetector 50 is converted into a digital signal by means of an analog-to-digital (ADC) converter unit 52 whose output is fed as a digital input to a central processing unit (CPU) 54. An encoder 14 provides an input to the CPU 54 to determine the timing of the operations of the currency handling system 10, and a flash memory 56 is provided for storing software codes and/or data related to operation of the currency handling system 10. A flash card 58 may be electrically connected to the flash memory 56 to provide updates or to copy from the flash memory 56, as will be described in detail hereinafter.

An operator interface panel 60 provides an operator the capability of sending input data to, or receiving output data from, the currency handling system 10. Input data may comprise, for example, user-selected operating modes and user-defined operating parameters for the currency handling system 10. Output data may comprise, for example, a display of the operating modes and/or status of the currency handling system 10 and the number or cumulative values of evaluated bills. In one embodiment, the operator interface panel 60 comprises a touch-screen "keypad" and display which may be used to provide input data and display output data related to operation of the currency handling system 10. In one embodiment, the operator may customize the touch-screen keypad to define names or labels associated with particular keys or displays, delete keys, reposition keys or modify the complexity of the operator interface panel 60 to match the level of operator experience. The user-tailored operating parameters are encoded in the control software executed by the CPU 54 and stored in the flash memory 56.

The characteristic information obtained from the scanned bill may comprise a collection of data values each being associated with a particular attribute of the bill. The attributes of a bill for which data may be obtained from magnetic sensing include, for example, patterns of changes in magnetic flux (U.S. Pat. No. 3,280,974), patterns of vertical grid lines in the portrait area of bills (U.S. Pat. No. 3,870,629), the presence of a security thread (U.S. Pat. No. 5,151,607), total amount of magnetizable material of a bill (U.S. Pat. No. 4,617,458), patterns from sensing the strength of magnetic fields along a bill (U.S. Pat. No. 4,593,184), and other patterns and counts from scanning different portions of the bill such as the area in which the denomination is written out (U.S. Pat. No. 4,356,473).

The attributes of a bill for which data may be obtained from optical sensing include, for example, density (U.S. Pat. No. 4,381,447), color (U.S. Pat. Nos. 4,490,846; 3,496,370; 3,480,785), length and thickness (U.S. Pat. No. 4,255,651), the presence of a security thread (U.S. Pat. No. 5,151,607) and holes (U.S. Pat. No. 4,381,447), reflected or transmitted intensity levels of UV light (U.S. patent application Ser. No. 08/317,349),now issued as U.S. Pat. No. 5,909,502, and other patterns of reflectance and transmission (U.S. Pat. Nos. 3,496,370; 3,679,314; 3,870,629; 4,179,685). Color detection techniques may employ color filters, colored lamps, and/or dichroic beamsplitters (U.S. Pat. Nos. 4,841,358; 4,658,289; 4,716,456; 4,825,246, 4,992,860 and EP 325, 364).

In addition to magnetic and optical sensing, other techniques of gathering test data from currency include electrical conductivity sensing, capacitive sensing (U.S. Pat. Nos. 5,122,754 [watermark, security thread]; 3,764,899 [thickness]; 3,815,021 [dielectric properties]; 5,151,607 [security thread]), and mechanical sensing (U.S. Pat. Nos. 4,381,447 [limpness]; 4,255,651 [thickness]). Each of the aforementioned patents relating to optical, magnetic or alternative types of sensing is incorporated herein by reference in its entirety.

Figure 4:
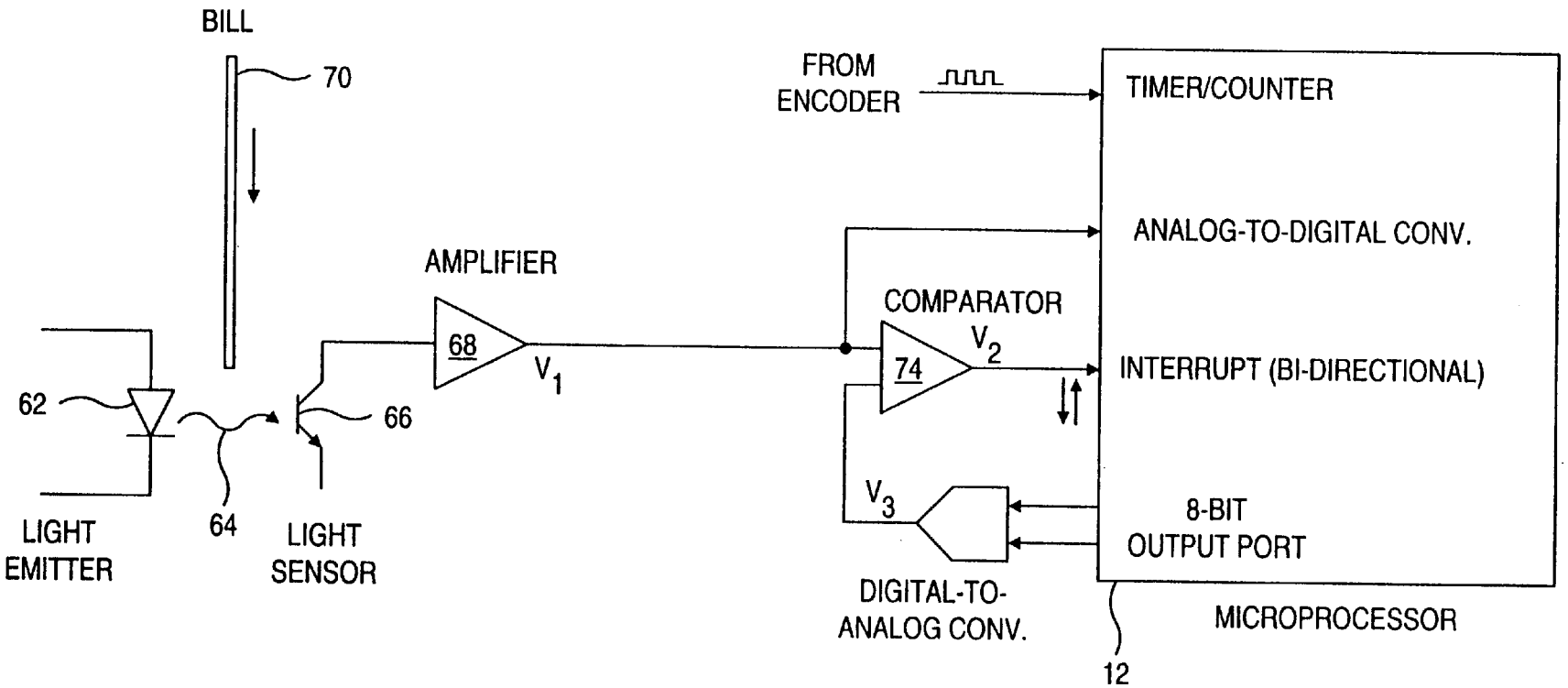
FIG. 4 is a block diagram of a digital size detection system which may be used in the currency handling systems of FIGS. 1 through 3.

FIG. 4 illustrates one embodiment of an optical sensing system which may be used to detect the size of a currency bill under test. The authentication or discrimination of currency based on size is particularly useful in foreign markets in which the size of individual bills varies with their denomination. As shown in FIG. 4, the size detection method includes a light emitter 62 adapted to send a light signal 64 toward a light sensor 66. The sensor 66 produces a signal which is amplified by amplifier 68 to produce a signal $V_1$ proportional to the amount of light passing between the emitter and sensor. A currency bill 70 is advanced across the optical path between the light emitter 62 and light sensor 66, causing a variation in the intensity of light received by the sensor 66. As will be appreciated, the bill 70 may be advanced across the optical path along its longer dimension or narrow dimension, respectively, depending on whether it is desired to measure the length or width of the bill.

At time $t_1$, before the bill 70 has begun to cross the path between the light emitter 62 and sensor 66, the amplified sensor signal $V_1$ is proportional to the maximum intensity of light received by the sensor 66. The maximum $V_1$ signal is digitized by an analog-to-digital converter and provided to the microprocessor 12, which divides it by two to define a $V_3$ signal, equal to one-half of the maximum value of $V_1$, as a reference to a comparator 74. The other input to the comparator 74 is provided by the amplified sensor signal $V_1$ which represents the varying intensity of light received by the sensor 66 as the bill 70 crosses the path between the emitter 62 and sensor 66. In the comparator 74, the varying sensor signal $V_1$ is compared to the $V_3$ reference, and an output signal is provided to an interrupt device whenever the varying sensor signal $V_1$ falls above or below the $V_3$ reference.

As can be seen more clearly in FIG. 5, the interrupt device thereafter produces a pulse 76 beginning at time $t_2$ (when the varying sensor signal $V_1$ falls below the $V_3$ reference) and ending at time $t_3$ (when the varying sensor signal $V_1$ rises above the $V_3$ reference). The length of the pulse 76 occurring between time $t_2$ and $t_3$ is computed by the microprocessor 12 with reference to a series of timer pulses from the encoder 14 (e.g., FIG. 1 or FIG. 3). More specifically, at time $t_2$, the microprocessor 12 begins to count the number of timer pulses received from the encoder and at time $t_3$ the microprocessor stops counting. The number of encoder pulses counted during the interval from time $t_2$ to time $t_3$ thereby represents the width of the bill 70 (if fed along its narrow dimension) or length of the bill 70 (if fed along its longer dimension).

It has been found that light intensity and/or sensor sensitivity will typically degrade throughout the life of the light emitter 62 and light sensor 66, causing the amplified sensor signal $V_1$ to become attenuated over time. The $V_1$ signal can be further attenuated by dust accumulation on the emitter or sensor. One of the advantages of the above-described size detection method is that it is independent of such variations in light intensity or sensor sensitivity. This is because the comparator reference $V_3$ is not a fixed value, but rather is logically related to the maximum value of $V_1$. When the maximum value of $V_1$ attenuates due to degradation of the light source, dust accumulation, etc., $V_3$ is correspondingly attenuated because its value is always equal to one-half of the maximum value of $V_1$. Consequently, the width of the pulse derived from the comparator output with respect to a fixed length bill will remain consistent throughout the life of the machine, independent of the degradation of the light source 62 and sensor 66.

Figure 5:
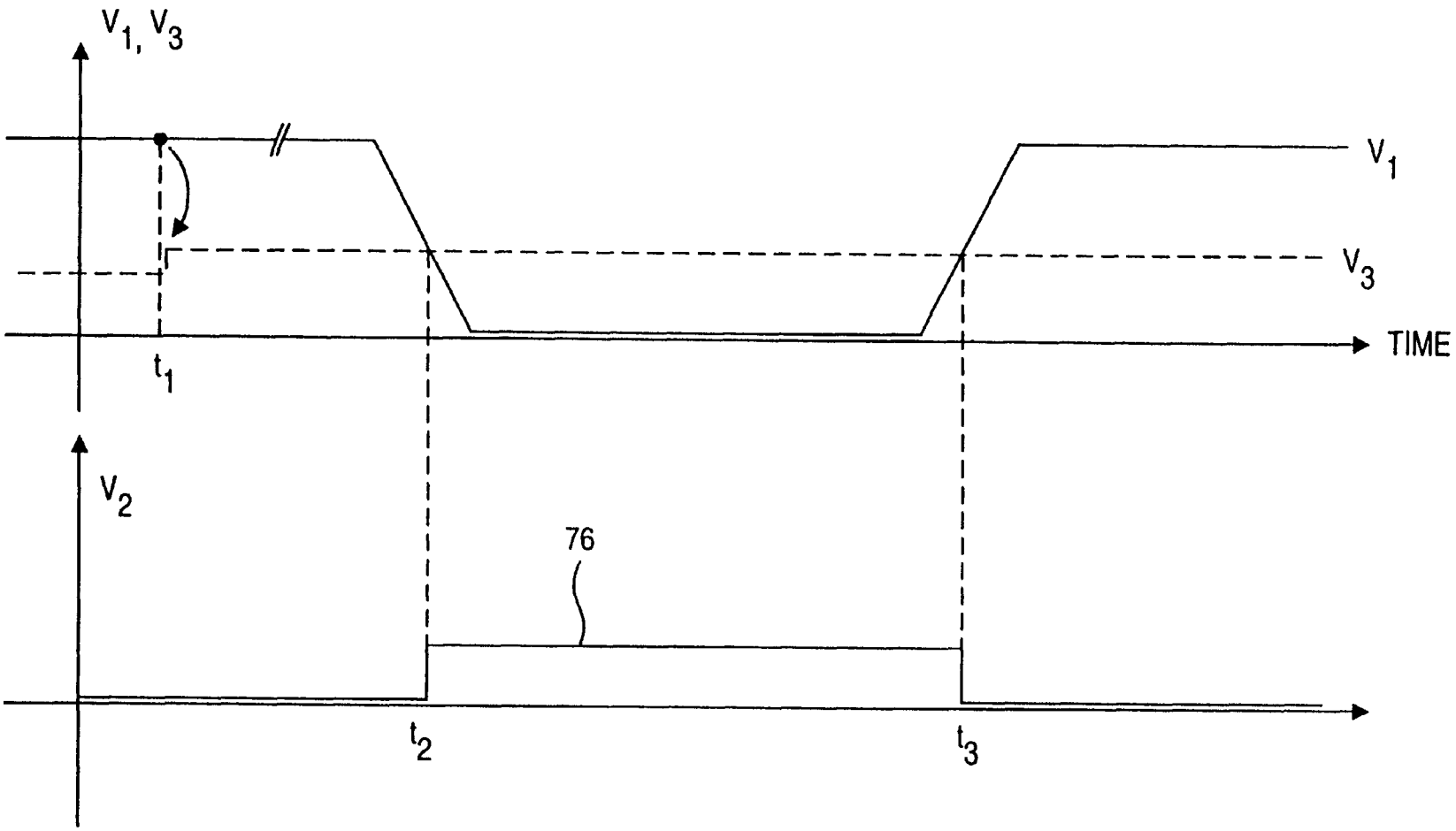
FIG. 5 is a timing diagram illustrating the operation of the size detection method of FIG. 4.
Figure 6:
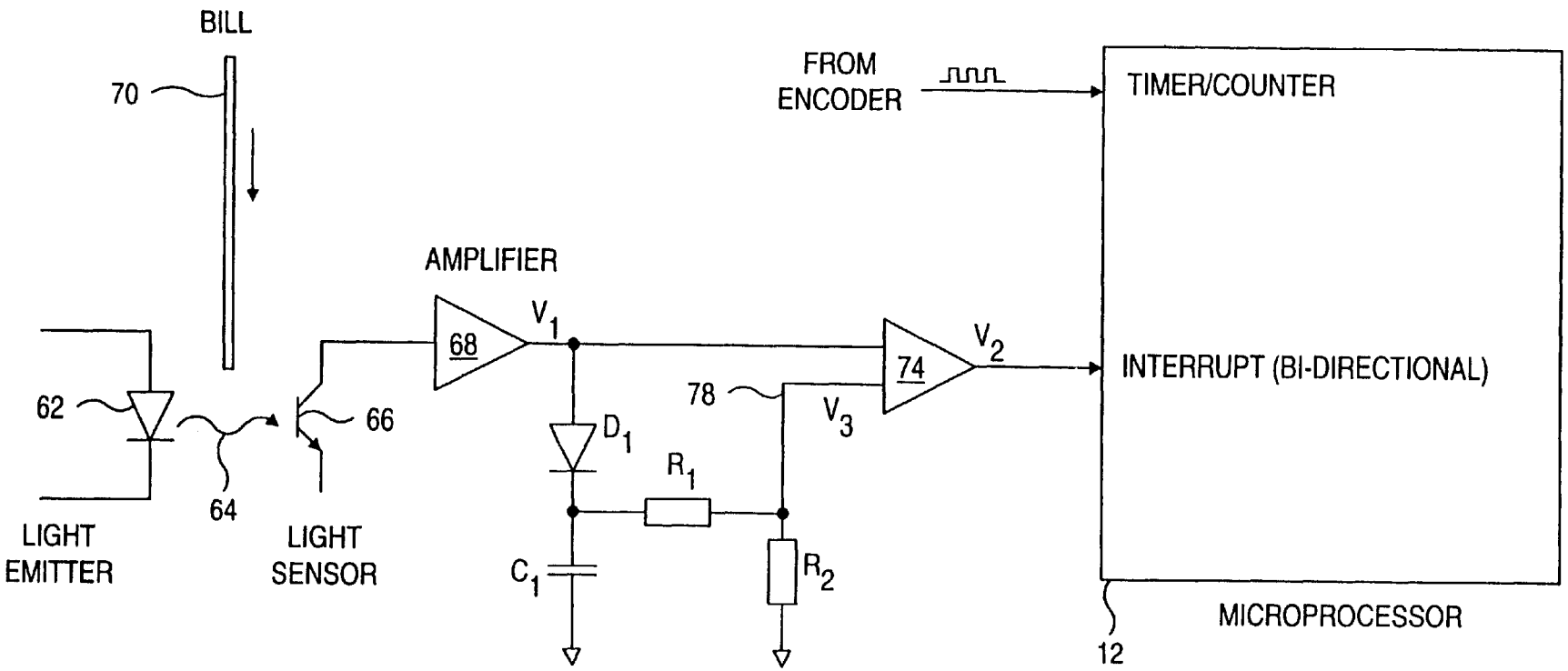
FIG. 6 is a block diagram of an analog size detection system which may be used in the currency handling systems of FIGS. 1 through 3.

FIG. 6 portrays an alternative circuit which may be used to detect the size of a currency bill under test. In FIG. 6, the method of size detection is substantially similar to that described in relation to FIG. 4 except that it uses analog rather than digital signals as an input to the comparator 74. A diode D1 is connected at one end to the output of the amplifier 68 and at another end to a capacitor C1 connected to ground. A resistor R1 is connected at one end between the diode D1 and capacitor C1. Another end of resistor R1 is connected to a resistor R2 in parallel with the reference input 78 of comparator 74. If R1 and R2 are equal, the output voltage $V_3$ on the reference input 78 will be one-half of the peak voltage output from amplifier 68. In the comparator 74, the varying sensor signal is compared to the output voltage $V_3$, and an output signal is provided to an interrupt device whenever the varying sensor signal falls above or below the $V_3$ reference. Thereafter, a pulse 76 is produced by the interrupt device and the length of the pulse 76 is determined by the microprocessor 12 counting the number of timer pulses occurring during the pulse, as described in relation to FIGS. 4 and 5. In the circuit of FIG. 6, as in the circuit of FIG. 4, the signal $V_3$ is proportional to $V_1$ and the width of pulses derived from the comparator output are independent of the degradation of the light source 62 and sensor 66.

Whatever type of sensing is employed, the test data representing the selected attributes of the bills under test is designed to be compared by the CPU 54 (FIG. 3) to master information associated with the selected attributes to determine the denomination or authenticity of the bills, based on selected sensitivity levels, as described above in relation to the "standard" mode of operation. More than one attribute or type of sensing may be used to evaluate a given bill. For example, in an embodiment utilizing size detection to provide an initial determination of authenticity of a bill, characteristic data associated with attributes other than size may be used to subsequently verify the initial determination.

As shown in FIG. 3, the CPU 54 is electrically connected to a flash memory 56, which in turn is adapted to be electrically connected to a flash card 58 having its own flash memory (not shown). The master information used in evaluating bills under test is stored in the flash memory 56. Upon connection of the flash card 58 to the flash memory 56, the contents of the flash memory, including the master information generated in the "learn" mode, are copied onto the flash card 58. Thereafter, the flash card 58 may be used to update the flash memorys of additional machines. In this system, therefore, the independent generation of master information accomplished in the "learn" mode need only be accomplished by one machine and quickly and efficiently loaded into other machines without repeating the "learn" mode in the other machines.

Flash memorys are relatively well known in the art. Some of the several advantages of flash memorys are that they are nonvolatile (e.g. their data content is preserved without requiring connection to a power supply) and they may be electrically erased and reprogrammed within fractions of a second through electrical control signals. An example of a specific type of flash memory which may be used in the currency handling system 10 is product number Am29FO10, commercially available from Advanced Micro Devices, Inc. ("AMD") of Sunnyvale, Calif. and described in detail in AMD's publication entitled "Flash Memory Products—1996 Data Book/Handbook", incorporated herein by reference. However, those skilled in the art will appreciate that other types of flash memorys may be utilized, depending on the system memory requirements and desired operating characteristics.

Figure 7A:
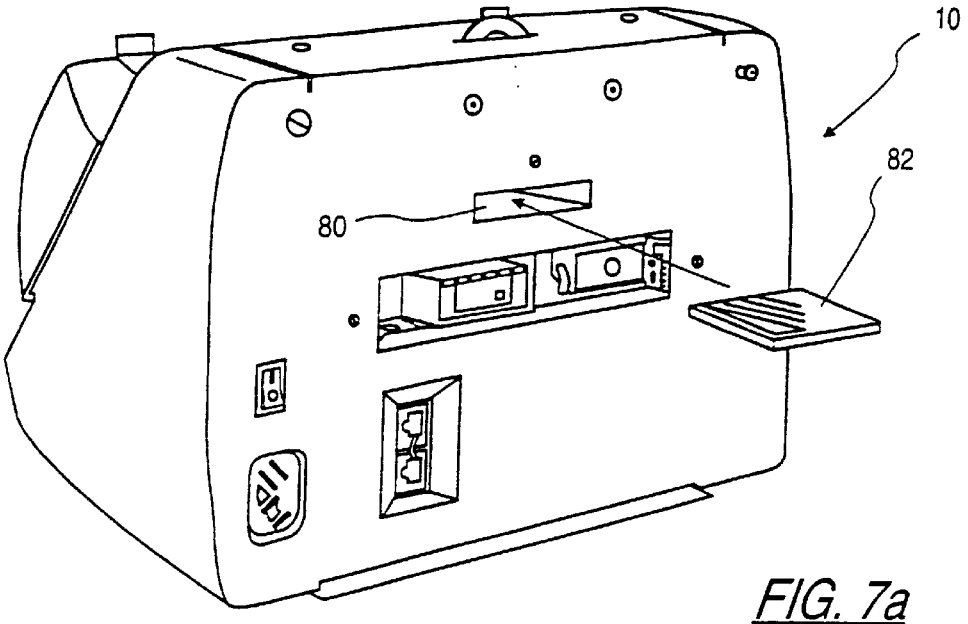
FIGS. 7*a* and 7*b* are isometric views depicting the insertion of a flash card into a currency handling machine according to one embodiment of the present invention.

FIG. 7*a* depicts a currency handling machine 10 having an external slot 80 for receiving a flash card according to one embodiment of the invention. A removable flash card 82 is adapted to be inserted by a user through the external slot 80 and into a mating socket 84 located inside the machine adjacent the slot 80. Upon insertion of the flash card 82 into the socket 84, an electrical connection is formed between the flash card 82 and the flash memory 86 resident in the machine. According to one embodiment, the flash card 82 is small and lightweight, sturdy enough to withstand multiple uses, and adapted to be easily insertable into the slot 80 and corresponding socket 84 of the currency handling machine 10 by users not having any special training. Further, the flash card 82 should not require any special electrostatic or physical protection to protect it from damage during shipping and handling. One type of flash card that has been found to satisfy these criteria is the FlashLite™ Memory Card available from AMP, Inc. of Harrisburg, Pa. However, it is envisioned that other suitable types of flash cards will become available from other manufacturers. The FlashLite™ card has a thickness of 3.3 mm (⅛ inch), a width of approximately 45 mm (1.8 inches) and a 68-pin connector interface compatible with the Personal Computer Memory Card International Association (PCMCIA) industry standards. Its length may be varied to suit the needs of the user. In one embodiment, two sizes of flashcards (designated "half size" and "full size") have lengths of 2.1 inches (53 mm) and 3.3 inches (84 mm), respectively, but other sizes of flash cards may also be utilized.

Figure 7B:
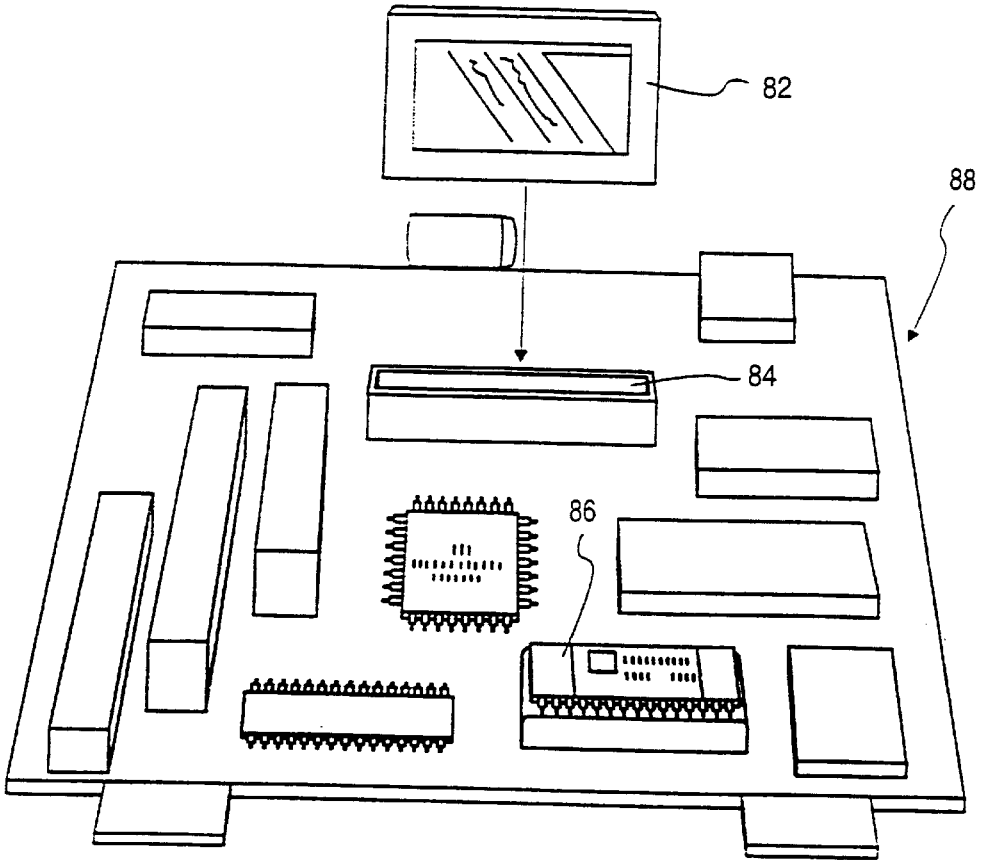

FIG. 7*b* depicts a circuit board assembly 88 including a socket 84 adapted to receive the flash card 82 according to one embodiment of the invention. As will be appreciated by those skilled in the art, however, the flash card 82 may be electrically coupled to the resident memory by any of several alternative means other than a socket. Upon insertion of the flash card 82 into the socket 84, electrical signals are communicated from the flash card 82 to the resident flash memory 86 of the machine. In one embodiment, the socket 84 comprises a PCMCIA-compatible 68-position receptacle for receiving a flash card such as the FlashLite™ card described above. One type of socket that may be used for this purpose is AMP, Inc. product number 146773-1, which is adapted to extend vertically from the circuit board assembly 88 within the currency handling machine 10. However, it will be appreciated by those skilled in the art that other types of sockets may be utilized, including those positioned horizontally in relation to the circuit board assembly 88, or those including a lever or button which may be depressed to eject the flash card 82 from the socket 84.

Upon insertion of the flash card 82 into its socket 84, the CPU is capable of electrically detecting the presence of the card. If the FlashLite™ card is used, this is accomplished by means of two specially designated connector pins $CD_1$ and $CD_2$ (assigned to pin numbers 36 and 67, respectively) being shorted to ground. The CPU then compares the contents of the flash card memory with the contents of the resident flash memory 86. If the contents of the memorys are different, the required sectors in the flash card memory are erased and replaced with new code copied from the resident flash memory 86. If the contents of the memorys are the same, an audible or visual message is provided to the user indicating that the process is concluded. Upon successful completion of the memory transfer, the flash card memory thereby is programmed with the same set of master information as the resident flash memory. The flash card 82 can thereafter be removed from the currency handling machine 10 and plugged into any other currency handling machine requiring that same set of master information. The master information is copied from the flash card memory to the flash memory of the additional machines in substantially the same manner (although reversed) as they were initially copied onto the flash card. In the event of an unsuccessful memory transfer, the machine will automatically re-attempt the transfer until, after multiple unsuccessful attempts, the user will be advised that there is a hard system failure and to call for service.

As described in relation to the size detection method of FIGS. 4 through 6 using optical sensors, it has been found that the light source and/or sensor of a particular machine may degrade over time. Additionally, the light source and/or sensor of any particular machine may be affected by dust, temperature, imperfections, scratches, or anything that may affect the brightness of the bulb or sensitivity of the sensor. Similarly, machines utilizing magnetic sensors will also generally degrade over time and/or be affected by its physical environment including dust, temperature, etc. When multiple machines are employed, as in the above-described system using flash cards to pass threshold data between multiple machines, each machine will typically have a measurement "bias" unique to that machine caused by the state of degradation of the optical or magnetic sensors associated with each individual machine. Due to the measurement biases between machines, master information generated by one machine will not directly correspond to such values in another machine. Consequently, if the measurement biases are not corrected, evaluation of bills will be inconsistent from machine to machine.

The present invention is designed to achieve a substantially consistent evaluation of bills between machines by "normalizing" the master information and test data to account for differences in sensors between machines. For example, where the master information and test data comprise numerical values, this is accomplished by dividing the threshold data and test data obtained from each machine by a reference value corresponding to the measurement of a common reference by each respective machine. The common reference may comprise, for example, an object such as a mirror or piece of paper or plastic that is present in each machine. The reference value is obtained in each respective machine by scanning the common reference with respect to a selected attribute such as size, density pattern, etc. The master information and/or test data obtained from each individual machine is then divided by the appropriate reference value to define normalized master information and/or test data corresponding to each machine. The evaluation of bills in standard mode may thereafter be accomplished by comparing the normalized test data to normalized master information.

The normalized master information may be obtained from one or more machines in "learn" mode and transferred to other machines by using the flash card process heretofore described. By using normalized master information to evaluate bills, a consistent evaluation of bills is achieved from machine to machine even though the sensors in each machine may be in different states of degradation. For example, suppose a first machine is operated in "learn" mode to derive master information, in the form of numerical threshold values, associated with optical sensing of a currency bill, and the threshold values are copied from the first machine to a second machine using the flash card process heretofore described. In actual terms, the threshold values derived by the first machine may comprise, for example, an upper limit of 2.0 volts and a lower limit of 1.0 volts. Suppose further that the first machine optically senses a reference object such as a piece of plastic and produces a reference value of 4.0 volts. The upper and lower threshold values are normalized by dividing them by the reference value, resulting in a normalized upper threshold of 0.5 and a normalized lower threshold of 0.25.

The normalized threshold values obtained from the first machine may then be transferred to a second machine including a reference object which is identical to or otherwise has the same measurable characteristics as the reference object in the first machine. Typically, the sensors in the second machine will be in a different state of degradation than the sensors in the first machine. For example, optical sensing of the reference object which produced a signal of 4.0 volts in the first machine may produce a signal of only 3.0 volts in the second machine. The second machine may nevertheless evaluate bills consistently with the first machine by comparing the normalized threshold values obtained from the first machine to normalized test data values obtained from the second machine. Alternatively, a consistent evaluation may be obtained by converting the normalized threshold values obtained from the first machine to "actual" (e.g., unnormalized) thresholds associated with the second machine and then comparing them to unnormalized test data obtained from the second machine.

For example, in the second machine described above, the normalized upper and lower thresholds obtained from the first machine (e.g., 0.5 and 0.25) may be converted to "actual" (e.g., unnormalized) thresholds appropriate to the second machine by multiplying the normalized values by the reference value (3.0 volts) obtained by the second machine. This results in an "actual" upper limit of 1.5 volts and an "actual" lower limit of 0.75 volts for the second machine. Evaluation of bills in standard mode may thereby be accomplished in the second machine by comparing "actual" data values of the bills under test to the "actual" threshold data derived from the normalized threshold data. Alternatively, the measured "actual" data values of the bills under test may be converted to normalized data values for comparison to the normalized threshold values.

Although the flash card loading system according to the present invention has heretofore been described in relation to the copying of master information, such as numerical threshold values, from machine to machine, it will be appreciated that the above described flash card loading system may be utilized to copy substantially all of the contents of the flash memory from one machine to the flash memory of other machines. In addition to master information, the contents of the flash memory may include, for example, tailored operating parameters associated with the particular currency handling machine 10 such as, for example, a user-defined keyboard and/or display which have been programmed to suit an individual operator or particular machine. By using the flash card loading system described above, these tailored operating parameters may be quickly and efficiently transferred from one machine to a second machine, thereby customizing the operating parameters of the second machine to match the operating parameters of the first machine.

According to another embodiment of the present invention, the operator or end user of the currency handling machine is provided with the ability to send control signals to the machine. The control signals may comprise, for example, an override signal causing the machine not to use master information generated internally through the "learn" mode. The override signal may send alternate master information to the machine to be used in place of the self-generated master information. The control signals may further include an attribute-selection signal for selecting the attributes of the bills for which master information will be obtained. For example, in a currency handling machine including both optical and magnetic sensors capable of measuring a variety of attributes, an operator may choose to use the attribute-selection signal to cause the currency handling machine to measure only a particular attribute or sub-combination of attributes. The control signals may also include an authentication mode selection signal for selecting which items of master information will be used in authentication of subsequent currency bills. For example, if master information corresponding to both size and density have been obtained, an operator may use the authentication mode selection signal to use only master information based on size to authenticate subsequent bills. Preferably, each of the above signals are separately definable for separate denominations of bills.

Figure 8:
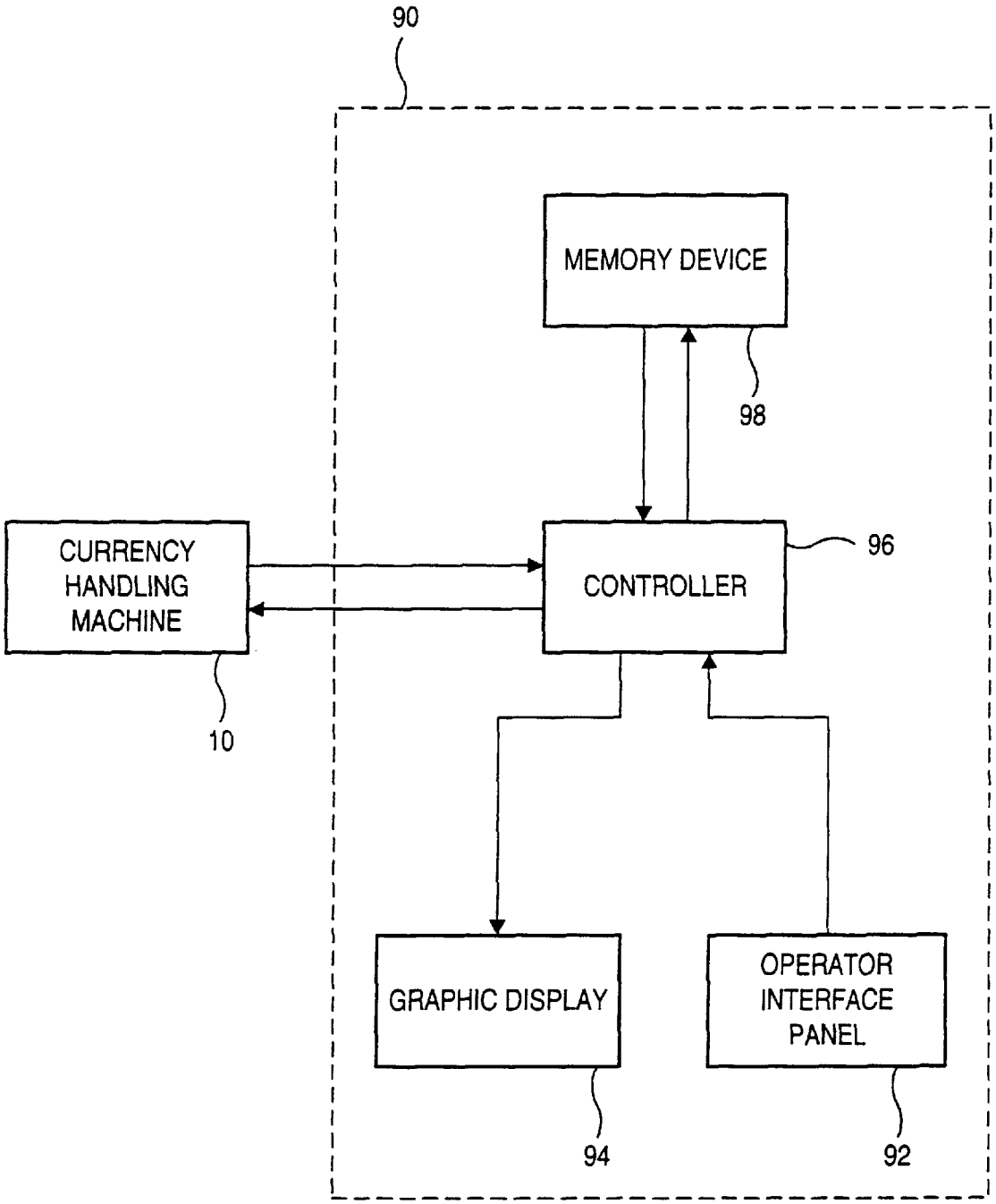
FIG. 8 is a block diagram showing the connection of a currency handling machine to a cash settlement machine according to one embodiment of the present invention.

FIG. 8 depicts one embodiment of the present invention in which the aforementioned control signals are sent to the currency handling machine 10 through a cash settlement machine 90. The cash settlement machine 90 is generally used to gather and record data relating to monetary transactions. For example, the operator of the cash settlement machine 90 may be a supervisor who is interested in the value of transactions performed by subordinates interacting with consumers at a transaction station. The cash settlement machine 90 records various financial data such as cash, coins, credit card receipts, coupons and other related data from each station. The data can be input into the cash settlement machine 90 manually or automatically via numerous peripheral machines such as the currency handling machine 10.

In the cash settlement machine 90, an operator interface panel 92 provides for operator interaction with the cash settlement machine 90. Typically, the operator interface panel 92 is a conventional mechanical keyboard with depressable keys. Alternatively, the cash settlement machine 90 may receive inputs from the operator through a touchscreen. Such a configuration is described in pending U.S. patent application Ser. No. 08/467,585 entitled "Cash Settlement Machine" which is commonly owned and is herein incorporated by reference in its entirety. The keyboard and/or the touchscreen are used to enter data, or to instruct the cash settlement machine 90 to perform a function such as data manipulation or communication with a peripheral device. A graphics display monitor 94 displays numerous data for the operator including the status of the cash settlement machine 90, the information that is being manipulated, the operability of a peripheral device, etc.

Additionally, the controller 96 of the cash settlement machine 90 may record data to or retrieve data from a memory device 98. The memory device 98 contains numerous registers for storing blocks of information. For example, each register may be associated with a cash settlement transaction or a particular worker and is labeled accordingly by the operator. The memory device 98 can be external or internal to the cash settlement machine 90, but generally it is internal. The memory device 98 also contains the software which the controller 96 operates to perform desired functions, including software used to communicate with the peripheral devices such as the currency handling system 10.

The types of data sent between the cash settlement machine 90 and the currency handling machine 10 may comprise for example, the number of notes counted or the value of the notes scanned. However, as described briefly above, the cash settlement machine 90 may also be used to remotely alter the operating characteristics of the currency handling system 10 through the use of control signals.

The remote altering of the sensitivity and density levels is especially useful when the operator of the cash settlement machine 90 is remotely located from the currency handling system 10 (in another room or a different building). The cash settlement machine 90 is also useful when the currency handling machine 10 comprises a prior art counter which only counts notes and has no means for determining denomination. In this situation, the operator of the cash settlement machine 90 knows that a certain denomination will be processed at the counter and so instructs the cash settlement machine 90. The cash settlement machine 90, upon receiving this instruction from the operator, sends a signal to the counter indicating the denomination that is to be processed. The counter then generates (in "learn" mode) or selects (in "standard" mode) the master information corresponding to the denomination to be processed. For example, the operator may enter at the host system that $20 notes will be processed. The host then relays to the counter that $20 notes will be counted. In learn mode, the counter then evaluates the representative set of $20 notes and generates a set of master information corresponding to the $20 notes. In standard mode, the counter evaluates the $20 notes with respect to the master information appropriate to $20 notes.

In the situation in which the currency handling system 10 comprises a denomination discriminator or discriminating counter, the operator does not need to enter the value of the notes to be evaluated. The operator may nevertheless still desire to send control signals, such as the override signal, attribute-selectionsignal or authentication mode selection signal to the currency handling system 10 as well as receive information from the currency handling system 10.

To accomplish the above-identified communication functions, the currency handling machine 10 must have the ability to react to signals received from the cash settlement machine 90. Therefore, in one embodiment, the currency handling machine 10 has an electrical port to which a communications cable (attached to the host system) is connected. The electrical port is coupled to the controller of the currency handling machine 10. Use of an established communications protocol allows the currency handling machine 10 to detect multiple signals from the cash settlement machine 90, differentiate between the signals, and perform the function associated with a given signal. Additionally, the protocol also may permit the sending of a counterfeit detection signal to the cash settlement machine 90 when the currency handling machine 10 processes a note that falls outside the proper threshold levels. These signals are sent via the electrical port and the communications cable.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A size-detecting note counter for counting a stack of test currency bills having the same denomination, said note counter comprising:

a light source in optical alignment with a sensor, said light source being adapted to direct a light beam along an optical path toward said sensor such that an amount of said light beam is detected by said sensor;

a transport mechanism for progressively advancing individual ones of said test currency bills across said optical path, the amount of said light beam detected by said sensor varying in response to the position of said individual test currency bills;

an amplifier for amplifying the amount of said light beam detected by said sensor to define an amplified sensor signal associated with each of said individual test currency bills;

a comparator for comparing said amplified sensor signal to a reference signal, said comparator triggering production of a pulse in response to said amplified sensor signal falling below said reference signal, said comparator triggering termination of said pulse in response to said amplified sensor signal rising above said reference signal;

a processor for determining the duration of said pulses corresponding to said individual test currency bills, the duration of said pulses corresponding to the size of said test bills, said processor being adapted to make an initial determination of the denomination of said stack of test bills by comparing the size of a first plurality of said test bills to the sizes of the different denominations of master currency bills, said processor subsequently being adapted to determine the authenticity of a second plurality of said test bills by comparing test data associated with each of said second plurality of test bills to the threshold data corresponding to the denomination of said test bills obtained by said initial determination, said processor further being adapted to count the number of authentic test bills in said stack.

2. A size-detecting note counter for counting a stack of test currency bills having the same denomination, said note counter being operable in a learn mode and a standard mode, said note counter comprising:

a light source in optical alignment with a sensor, said light source being adapted to direct a light beam along an optical path toward said sensor such that an amount of said light beam is detected by said sensor;

a transport mechanism for progressively advancing individual currency bills across said optical path, the amount of said light beam detected by said sensor varying in response to the position of said individual currency bills, said individual currency bills comprising master currency bills in said learn mode and test currency bills in said standard mode;

an amplifier for amplifying the amount of said light beam detected by said sensor to define an amplified sensor signal associated with each of said individual currency bills;

a comparator for comparing said amplified sensor signal to a reference signal, said comparator triggering production of a pulse in response to said amplified sensor signal falling below said reference signal, said comparator triggering termination of said pulse in response to said amplified sensor signal rising above said reference signal;

a processor for determining the duration of said pulses corresponding to said individual currency bills, the duration of said pulses in said learn mode corresponding to the sizes of different denominations of said master currency bills, the duration of said pulses in said standard mode corresponding to the size of said test bills, said processor being adapted in said learn mode to derive threshold data from the size of said master currency bills, each item of said threshold data corresponding to the size of a particular denomination of said master currency bills, said processor being adapted in said standard mode to make an initial determination of the denomination of said test bills by comparing the size of said test bills to the sizes of the different denominations of master currency bills.

3. The note counter of claim 2 wherein said processor automatically selects an authentication sensitivity level corresponding to the initial determination of denomination of said currency bills, said processor determining the authenticity of said test bills by comparing test data associated with each of said test bills to the threshold data corresponding to the selected sensitivity level.

4. The note counter of claim 2 in which the transport mechanism advances said individual currency bills in their longer dimension across said optical path, the size of said individual currency bills being defined by the length of said individual currency bills.

5. The note counter of claim 2 in which the transport mechanism advances said individual currency bills in their narrow dimension across said optical path, the size of said individual currency bills being defined by the width of said individual currency bills.

6. The note counter of claim 2 further comprising means for displaying the cumulative value of said currency bills.

7. The note counter of claim 2 wherein said reference signal is proportional to a maximum value of said amplified sensor signal.

8. The note counter of claim 7 wherein said reference signal is one-half the maximum value of said amplified sensor signal.

9. The note counter or claim 2 wherein the processor is adapted in said standard mode to determine the authenticity of said test bills by comparing test data associated with each of said test bills to the threshold data corresponding to the denomination of said test bills obtained by said initial determination, said processor further being adapted in said standard mode to count the number of authentic test bills in said stack.

10. A currency authenticating machine operable in a learn mode and a standard mode, said currency authenticating machine comprising:

one or more sensors adapted in said learn mode to scan master currency bills to obtain master information associated with one or more attributes of said master currency bills, one or more sensors adapted in said standard mode to scan test bills to obtain test data associated with one or more attributes of said test bills;

a processor adapted in said standard mode to determine the authenticity of each of said test bills by comparing the test data associated with a selected one or more of said attributes to the master information corresponding to the selected one or more of said attributes; and a resident flash memory for storing said master information;

wherein said processor is adapted in said learn mode to derive a plurality of numerical thresholds from said master information, each of said numerical thresholds corresponding to a value of one of said attributes in a particular denomination of currency, wherein said sensors are adapted to scan a reference object to obtain one or more reference data values each corresponding to respective attributes of said reference object, said processor being adapted to divide said numerical thresholds and said test data by said reference data values to define normalized numerical thresholds and normalized test data associated with said one or more attributes, said processor being adapted to determine the authenticity of said test bills by comparing the normalized test data associated with a selected one of said attributes to the normalized numerical thresholds associated with the selected one of said attributes.

11. The currency authenticating machine of claim 10 further comprising:

a flash card having a flash card memory; and a socket adapted to removably receive said flash card therein, said socket being electrically coupled to said resident flash memory of said currency authenticating machine, wherein said normalized numerical thresholds are copied from said resident flash memory to said flash card memory in response to said flash card being inserted into said socket, said flash card thereafter being adapted to be removed from said socket and electrically coupled to a plurality of secondary currency authenticating machines, said normalized numerical thresholds being copied from said flash card memory to the resident flash memorys of the secondary currency authenticating machines in response to the flash card being electrically coupled to the plurality of secondary currency authenticating machines.

12. In combination, the currency authenticating machine of claim 11 and a plurality of secondary currency authenticating machines, each of said secondary currency authenticating machines being operable in said standard mode and comprising:

a resident flash memory for storing said normalized numerical thresholds received from said flash card;

one or more sensors for scanning test bills to obtain test data associated with one or more attributes of said test bills, said sensors further being adapted to scan a reference object to obtain reference data values associated with one or more attributes of said reference object; and a processor for dividing individual items of said test data by said reference data values to define normalized test data associated with said one or more attributes, said processor being adapted to determine the authenticity of said test bills by comparing the normalized test data associated with a selected one or more of said attributes to the normalized numerical thresholds associated with the selected one or more of said attributes.

13. A currency authenticating method comprising the steps of:

scanning master currency bills to obtain master information associated with one or more attributes of said master currency bills;

deriving a plurality of numerical thresholds from said master information, each of said numerical thresholds corresponding to a value of one of said attributes in a particular denomination of currency, storing said numerical thresholds in a resident flash memory;

scanning test bills to obtain test data corresponding to the value of at least one of said attributes in each of said test bills;

determining the authenticity of each of said test bills by comparing the test data associated with a selected one or more of said attributes to the numerical thresholds corresponding to the selected one or more of said attributes;

scanning a reference object to obtain one or more reference data values corresponding to respective attributes of said reference object;

dividing said numerical thresholds and said test data by said reference data values to define respective normalized numerical thresholds and normalized test data associated with said one or more attributes; and determining the authenticity of said test bills by comparing the normalized test data associated with a selected one of said attributes to the normalized numerical thresholds associated with the selected one of said attributes.

14. The currency authenticating method of claim 13 further comprising the steps of:

electrically coupling a flash card to said resident flash memory, said flash card having a flash card memory therein, said normalized numerical thresholds being copied from said resident flash memory to said flash card memory in response to electrically coupling said flash card to said resident flash memory;

uncoupling said flash card from said resident flash memory; and electrically coupling said flash card to a plurality of secondary currency authenticating machines, said normalized numerical thresholds being copied from said flash card memory to respective resident flash memorys of the secondary currency authenticating machines in response to the flash card being electrically coupled to the plurality of secondary currency authenticating machines.

15. The currency authenticating method of claim 14 further comprising the steps of:

scanning test bills in each of said secondary machines to obtain test data associated with one or more attributes of said test bills;

scanning a reference object in each of said secondary machines to obtain reference data values associated with one or more attributes of said reference object;

dividing said test data by said reference data value in each of said secondary machines to define normalized test data associated with said one or more attributes; and determining the authenticity of said test bills in each of said secondary machines by comparing the normalized test data associated with a selected one of said attributes to the normalized numerical thresholds associated with the selected one of said attributes.

16. A currency evaluating method comprising the steps of:

scanning master currency bills to obtain master information associated with one or more attributes of said master currency bills;

storing said master information in a memory;

scanning test bills to obtain test data;

scanning a reference object to obtain one or more reference data values;

dividing said master information and said test data by said reference data values to define respective normalized master information and normalized test data associated with said one or more attributes; and evaluating each of said test bills by comparing the normalized test data associated to the normalized master information.

* * * * *